US008162469B2

(12) United States Patent
Rea et al.

(10) Patent No.: US 8,162,469 B2
(45) Date of Patent: Apr. 24, 2012

(54) METHOD FOR ACHIEVING UNIFORM MEDIA TEMPERATURE AND SIZE THROUGHOUT THE PRE-HEAT ZONE

(75) Inventors: Jennifer Joyce Rea, Rush, NY (US); Jason Matthew LeFevre, Penfield, NY (US); Roger G. Leighton, Rochester, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 338 days.

(21) Appl. No.: 12/561,413

(22) Filed: Sep. 17, 2009

(65) Prior Publication Data

US 2011/0063374 A1 Mar. 17, 2011

(51) Int. Cl.
*B41J 2/01* (2006.01)

(52) U.S. Cl. ..... 347/102

(58) Field of Classification Search ..... 347/54, 347/56, 60–62, 102, 104
See application file for complete search history.

(56) References Cited

U.S. PATENT DOCUMENTS

| | | | | |
|---|---|---|---|---|
| 5,896,154 | A * | 4/1999 | Mitani et al. | 347/102 |
| 6,231,176 | B1 * | 5/2001 | Peter | 347/102 |
| 6,913,354 | B2 * | 7/2005 | Rasmussen et al. | 347/102 |
| 2009/0009573 | A1 | 1/2009 | Larson et al. | |
| 2009/0021550 | A1 | 1/2009 | Leighton et al. | |
| 2009/0116888 | A1 | 5/2009 | Kladius et al. | |

* cited by examiner

*Primary Examiner* — An Do
(74) *Attorney, Agent, or Firm* — Maginot, Moore & Beck, LLP

(57) ABSTRACT

An imaging device includes a source of a substantially continuous web of media, and a web transport system configured to transport the continuous web from the source along a web path having a print zone. At least one printhead arranged along the web path in the print zone and configured to deposit ink onto the web to form images. A preheating system is positioned along the web path between the source and the print zone. The preheating system includes a first heating stage and a second heating stage. The first heating stage has at least one heater configured to heat the web to an initial preheat temperature prior to reaching the second stage. The second stage includes at least one heater configured to reduce a temperature of the web from the initial preheat temperature to a target temperature for the preheating system.

15 Claims, 2 Drawing Sheets

METHOD FOR ACHIEVING UNIFORM MEDIA TEMPERATURE AND SIZE THROUGHOUT THE PRE-HEAT ZONE

TECHNICAL FIELD

The present disclosure relates to ink-jet printing, and, in particular, to ink-jet printing using phase-change inks on a substantially continuous web.

BACKGROUND

In general, ink jet printing machines or printers include at least one printhead that ejects drops or jets of liquid ink onto a recording or image forming media. A phase change ink jet printer employs phase change inks that are substantially solid or gelatinous at ambient temperature and that transition to a liquid phase at an elevated temperature. The liquid phase change ink, also referred to herein as melted ink or molten ink, can then be ejected onto a printing media by a printhead onto an image receiving substrate, referred to as direct to media printing, or onto an intermediate imaging member and subsequently transferred to an image receiving substrate, referred to as indirect printing. Once the ejected ink is on the image receiving substrate, the ink droplets quickly solidify to form an image.

In both the direct and offset printing architecture, the image receiving substrate may comprise individual media sheets or a substantially continuous supply of media, also referred to as a media web. In a web printer, the continuous supply of media is typically provided in a media roll mounted onto rollers that are driven by motors. A loose end of the media web is passed through a print zone that includes a plurality of printheads arranged to deposit the molten phase change ink onto the web to form images. Beyond the print zone, the media web is gripped and pulled by mechanical structures so a portion of the media web continuously moves through the print zone. A high pressure roller nip, also referred to as a spreader, arranged downstream from the print zone may be used after the ink is jetted onto the web in the print zone to spread the ink on the web to achieve the desired print quality. The function of the spreader is to take what are essentially isolated droplets of ink on web and smear them out to make a continuous layer by pressure and/or heat so that spaces between adjacent drops are filled and image solids become uniform.

In order to achieve acceptable ink spreading performance at the spreader, as well as other image quality metrics, such as ink color mixing, ink to web adhesion, and the like, current phase change ink print processes require that the web temperature be maintained at a target temperature within the print zone. The target temperature is dependent upon a number of factors, such as the media type and ink formulation. For example, for a nominal 75 gsm paper, phase change ink print processes may require that the web be heated to and maintained at a temperature of approximately 55° C. in the print zone. To achieve the target preheating temperature, previously known systems typically included a preheater in the form of a heated roller positioned to be partially wrapped by the web prior to the web entering the print zone. The preheat roller in such previously known systems is heated to a temperature that enables conductive heat transfer to occur between the web and the roller surface to bring the temperature of the web to the target preheating temperature. In addition, heaters in the form of rollers, backing members, or the like may be arranged in the print zone to maintain the web of media at the target temperature as the ink is deposited thereon by the printheads.

One challenge faced in preheating the web to the target temperature and maintaining the web at the target temperature through the print zone is shrinkage of the media. For example, under common ambient atmospheric conditions, e.g., approximately 25° C., paper commonly used for ink jet printing can have a moisture content that may range, depending on actual humidity, from about 1% to 10%. When a continuous web of paper is brought into contact with a preheat roller, the moisture in the fibers of the paper is driven out and the paper begins to shrink. As mentioned, some previously known systems have a target temperature for the preheater of about 55° C. While the preheat roller in such systems may be capable of heating the web to the desired target temperature, the web may not be heated long enough prior to entering the print zone for the paper's water content to equilibrate. Thus, even when preheated to the target temperature, the web may continue to shrink after entering the print zone which makes registering colors more difficult. Tests have shown that one 20" wide web of paper heated to 55° C. and kept at that temperature may shrink by as much as 2 mm during printing.

Another challenge faced in operating a web preheater is maintenance of a consistent, or uniform, temperature at the heating surface of the preheater that enables the web to be heated to the target temperature. As mentioned, the web is typically at ambient temperature prior to contacting the preheat roller. Therefore, the temperature of the web may have to be raised approximately 30° C. to reach a target preheating temperature of 55° C. The surface of the preheat roller loses energy, or heat, as it is contacted by the lower temperature web. Consequently, a preheat roller may have to be heated to a temperature well above the target preheat temperature in order to compensate for the loss of heat that results from contact with the web. As an example, to achieve a target preheating temperature of approximately 55° C. at a web speed of approximately 80 ips, the preheat roller may have to be heated to about 70-75° C. The large temperature gradient of the web as it is heated from ambient to about 55° C. by the heated roller surface may cause the web to remove more energy from the roller surface than the heating element of the preheat roller can replace in a timely fashion. Tests have shown that a preheat roller heated to about 75° C. and contacted with a web traveling about 80 ips may have a drop in temperature of as much as 4-5° C. As a result of the temperature drop, the temperature at the surface of the preheat roller may be subject to temperature fluctuations which in turn may cause uneven heating of the web and inconsistent image quality. Temperature fluctuations and variations at the surface of the preheat roller may also cause diameter changes along the axis of the roller that may adversely impact the ability of the imaging device to register images on the web formed by the different printheads.

To address the challenges of web shrinkage and preheat roller temperature fluctuations, previously known systems lowered the target temperature for the preheat roller to, for example, 45° C., thus decreasing the difference between the incoming web temperature and the preheat roller set point temperature, in this case, from 30° C. to approximately 20° C. Decreasing the temperature difference between the incoming web and the pre-heat roll set point results in the preheat roller losing less energy to heat the web to the target temperature thereby reducing the magnitude of temperature variations in the preheat roller and the problems associated therewith. For example, at a lower preheat temperature set-point of 45° C., the preheat roller surface temperature drops very little, e.g., approximately 1° C., when contacted by the web at ambient temperature, and the lower preheat and print temperatures also result in less moisture being driven from the media so that there is a smaller change in media size during printing. While lowering the preheat target temperature of the preheat roller may be effective in reducing the problems associated with temperature fluctuations at the roller surface and media shrinkage in the print zone, the lower web temperature may decrease the image quality of the resulting images due to reduced spreading performance at the spreader and reduced ink to web adhesion.

SUMMARY

As an alternative to previously known preheating systems, a preheating system has been developed that enables uniform heating of the web to the full target temperature for printing while counteracting the effects of media resizing, or shrinking, in the print zone. In one embodiment, an imaging device that has been provided with such a preheating system includes a source of a substantially continuous web of media, and a web transport system configured to transport the continuous web from the source along a web path having a print zone. At least one printhead is arranged along the web path in the print zone that is configured to deposit ink onto the web to form images. A preheating system is positioned along the web path between the source and the print zone. The preheating system includes a first heating stage and a second heating stage. The first heating stage has at least one heater configured to heat the web to an initial preheat temperature prior to reaching the second stage. The second stage includes at least one heater configured to reduce a temperature of the web from the initial preheat temperature to a target temperature for the preheating system.

In another embodiment, a method of operating a continuous feed, direct marking imaging device includes transporting a substantially continuous web along a web path having a preheating system arranged adjacent thereto and a print zone arranged downstream from the preheating system. The web is heated to an initial preheat temperature at a first heating stage of the preheating system; and the temperature of the web is reduced from the initial preheat temperature to a target temperature for the web at a second heating stage of the preheating system. After reducing the temperature of the web to the target temperature, ink is deposited onto the web in the print zone to form images.

In yet another embodiment, an imaging device includes a source of a substantially continuous web of media, and a web transport system configured to transport the continuous web from the source along a web path having a print zone. At least one printhead is positioned adjacent the web in the print zone that is configured to deposit melted phase change ink onto the web to form images. A preheating system is positioned along the web path between the source and the print zone. The preheating system includes a first heating stage and a second heating stage. The first heating stage has at least one heater configured to heat the web to an initial preheat temperature prior to reaching the second stage. The second stage includes at least one heater configured to reduce a temperature of the web from the initial preheat temperature to a target temperature for the preheating system. A spreader is positioned along the web path downstream from the print zone that is configured to apply pressure to the web and the ink deposited thereon in the print zone.

DETAILED DESCRIPTION

Figure 1:
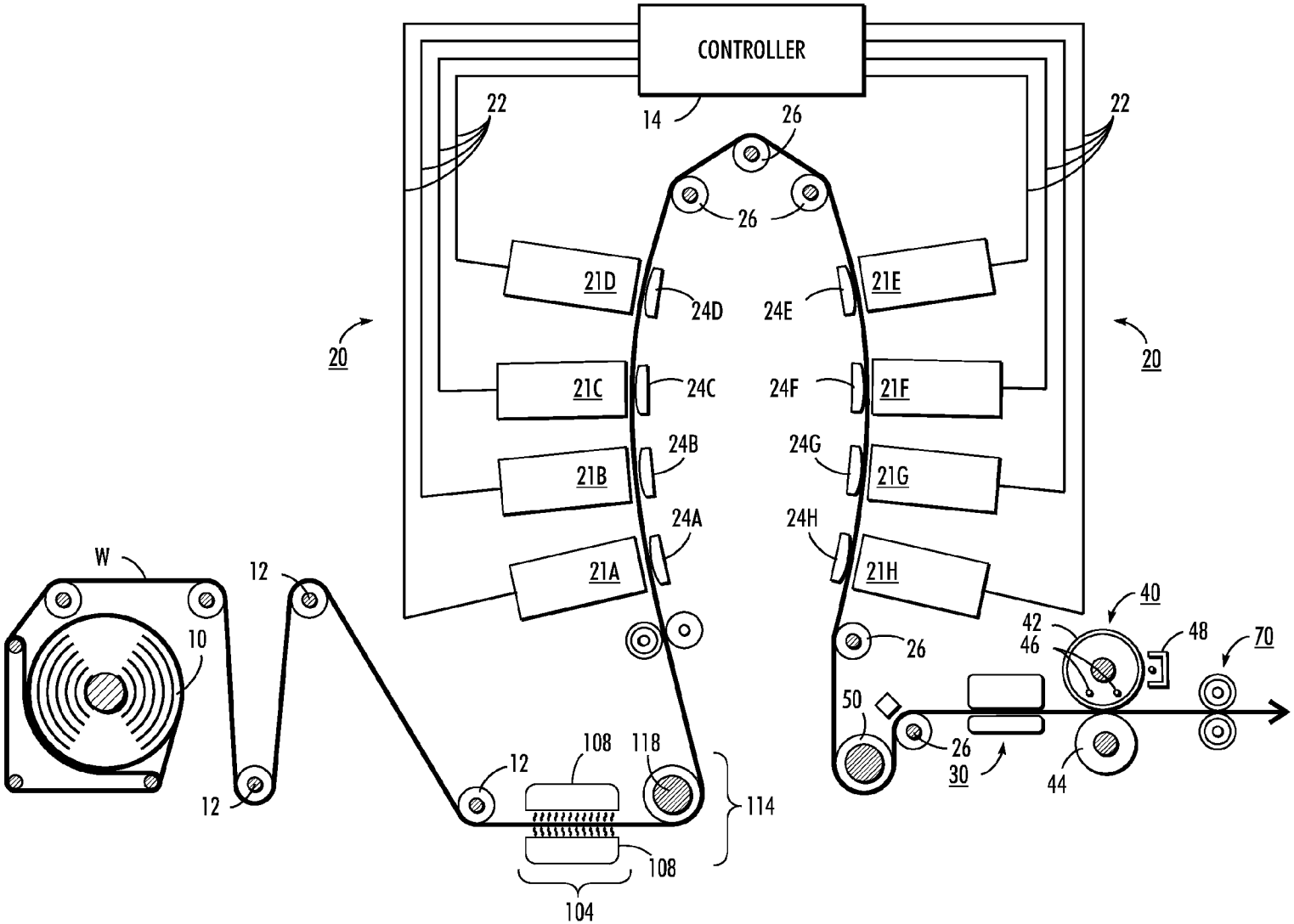
FIG. 1 is a simplified elevational view of a direct-to-sheet, continuous-web, phase-change ink printer.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is transferred moves through the imaging device. The cross-process direction, along the same plane as the image receiving surface, is substantially perpendicular to the process direction.

FIG. 1 is a simplified elevational view of a direct-to-sheet, continuous-web, phase-change ink printer. A web supply and handling system is configured to supply a very long (i.e., substantially continuous) web W of "substrate" (paper, plastic, or other printable material) from a spool 10. The web W may be unwound as needed, and propelled by a variety of motors, not shown. The web supply and handling system is capable of transporting the web W at a plurality of different speeds. A set of rolls 12 controls the tension of the unwinding web as the web moves through a path.

Along the path there is provided preheating system 100 configured to bring the web to a predetermined target temperature for printing, which in one practical embodiment, depending on the media type and ink formulation, is in a range of about 30° C. to about 70° C. (explained in more detail below). After the preheating system 100, the web W moves through a printing station 20 including a series of printheads 21A-21H, each printhead effectively extending across the width of the web and being able to place ink of one primary color directly (i.e., without use of an intermediate or offset member) onto the moving web. Eight printheads are shown in FIG. 1 although more or fewer printheads may be used. As is generally familiar, each of the four primary-color images placed on overlapping areas on the web W combine to form color images, based on the image data sent to each printhead through image path 22 from print controller 14. In various possible embodiments, there may be provided multiple printheads for each primary color; the printheads can each be formed into a single linear array. The function of each color printhead can be divided among multiple distinct printheads located at different locations along the process direction; or the printheads or portions thereof can be mounted movably in a direction transverse to the process direction P, such as for spot-color applications.

In one embodiment, the marking media applied to the web is a "phase-change ink," by which is meant that the ink is substantially solid at room temperature and substantially liquid when initially jetted onto the web 14. Currently-common phase-change inks are typically heated to about 100° C. to 140° C., and thus in liquid phase, upon being jetted onto the web W. Generally speaking, the liquid ink cools down quickly upon hitting the web W. In alternative embodiments, however, any suitable marking material or ink may be used including, for example, ultraviolet (UV) curable ink, toner or aqueous ink.

Each printhead may have a backing member 24A-24H, typically in the form of a bar or roll, which is arranged substantially opposite the printhead on the other side of web W. Each backing member is used to position the web W so that the gap between the printhead and the sheet stays at a known, constant distance. Each backing member can be controlled to cause the adjacent portion of the web to reach a predetermined "ink-receiving" temperature, in one practical embodiment, of about 40° C. to about 60° C. In various possible embodiments, each backing member can include heating elements, cavities for the flow of liquids therethrough, etc.; alternatively, the "member" can be in the form of a flow of air or other gas against or near a portion of the web W. The combined actions of preheater 18 plus backing members 24 held to a particular target temperature effectively maintains the web W in the printing zone 20 in a predetermined temperature range of about 40° C. to 70° C.

As the partially-imaged web moves to receive inks of various colors throughout the printing station 20, the temperature of the web is maintained within a given range. Ink is jetted at a temperature typically significantly higher than the receiving web's temperature which heats the surrounding paper (or whatever substance the web W is made of). Therefore the members in contact with or near the web in zone 20 must be adjusted so that that the desired web temperature is maintained. For example, although the backing members may have an effect on the web temperature, the air temperature and air flow rate behind and in front of the web may also impact the web temperature. Accordingly, air blowers or fans may be utilized to facilitate control of the web temperature.

The web temperature is kept substantially uniform for the jetting of all inks from printheads in the printing zone 20. This uniformity is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, this web temperature uniformity may be achieved by preheating the web and using uncontrolled backer members, and/or by controlling the different backer members 24A-24H to different temperatures to keep the substrate temperature substantially constant throughout the printing station. Temperature sensors (not shown) associated with the web W may be used with a control system to achieve this purpose, as well as systems for measuring or inferring (from the image data, for example) how much ink of a given primary color from a printhead is being applied to the web W at a given time. The various backer members can be controlled individually, using input data from the printhead adjacent thereto, as well as from other printheads in the printing station.

Following the midheaters 30, along the dual path of web W, is a "spreader" 40, that applies a predetermined pressure, and in some implementations, heat, to the web W. The function of the spreader 40 is to take what are essentially isolated droplets of ink on web W and smear them out to make a continuous layer by pressure, and, in one embodiment, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rolls, such as image-side roll 42 and pressure roll 44, that apply heat and pressure to the web W. Either roll can include heat elements to bring the web W to a temperature in a range from about 35° C. to about 80° C. In embodiments of the imaging device that utilize UV curable inks, the spreader may be replaced with one or more UV curing lamps, as are known in the art, that direct ultraviolet light onto the UV curable ink that forms the images on the web.

To further control the temperature of the web and/or the ink on the web, a leveling roller and one or more midheaters may be positioned along the web path following the printing zone prior to entering the spreader. For example, as shown in FIG. 1, a leveler roller 50 may be placed along the web path between the printing zone and the spreader 40. In one embodiment, the leveler roller 50 is configured as an idler roller that derives its rotational motion from frictional engagement of the roller surface with the moving web. However, the leveler roller may be a driven in accordance with the web speed by a drive mechanism (not shown), such as a drive motor operably coupled to the roller. Suitable coupling may be through a drive belt, pulley, output shaft, gear or other conventional linkage or coupling mechanism. Tension rollers 26 may also be provided to control the carrying in angle and/or carrying out angle of the web relative to the leveler roller 50.

The leveler roller 50 is a temperature controlled, thermally conductive roller designed to operate at a temperature lower than the incoming ink and web temperatures. In one embodiment, the leveler roller is configured to operate at a target temperature of about 30° C. to about 45° C. Any suitable leveler roller operating temperature, however, may be used. The leveler roller may include a core 58 formed of a thermally conductive material, such as anodized aluminum, although the core may be made of other suitable materials, such as iron, nickel, stainless steel, and various synthetic resins. The development of thermal energy in the leveler roller 50 may be accomplished in any suitable manner. For example, the core 58 may be hollow and include one or more heating elements 64 disposed therein for generating the required thermal energy in the roller.

Midheaters may be positioned along the web path downstream from the leveler roller. Midheaters 30 can use contact, radiant, conductive, and/or convective heat to bring the web W to the target temperature. The midheaters 30 bring the ink placed on the web to a temperature suitable for desired properties when the ink on the web is sent through the spreader 40. In one embodiment, a useful range for a target temperature for the midheater is about 35° C. to about 80° C. The midheaters 30 have the effect of equalizing the ink and substrate temperatures to within about 15° C. of each other. Lower ink temperature gives less line spread while higher ink temperature causes show-through (visibility of the image from the other side of the print). The midheaters 30 adjust substrate and ink temperatures to 0° C. to 20° C. above the temperature of the spreader.

Operation and control of the various subsystems, components and functions of the device 11 are performed with the aid of a controller 14. The controller 14 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

As mentioned, the imaging device includes a preheating system that is configured to heat the web to a target temperature. Previously known preheating systems typically included a single stage of heating in the form of a preheat roller configured to add heat to the incoming web to heat the web to the target temperature prior to the web entering the print zone. While such previously known single stage preheating systems are generally capable of heating the web to the desired target temperature, the web may not be heated long enough prior to entering the print zone to drive moisture out of the web to counteract the effects of media resizing in the print zone. In addition, large temperature gradients between the incoming paper and the preheat roller surface in the previously known preheating systems may cause temperature fluctuations at the roller surface resulting in uneven heating and possibly inconsistent image quality.

Figure 2:
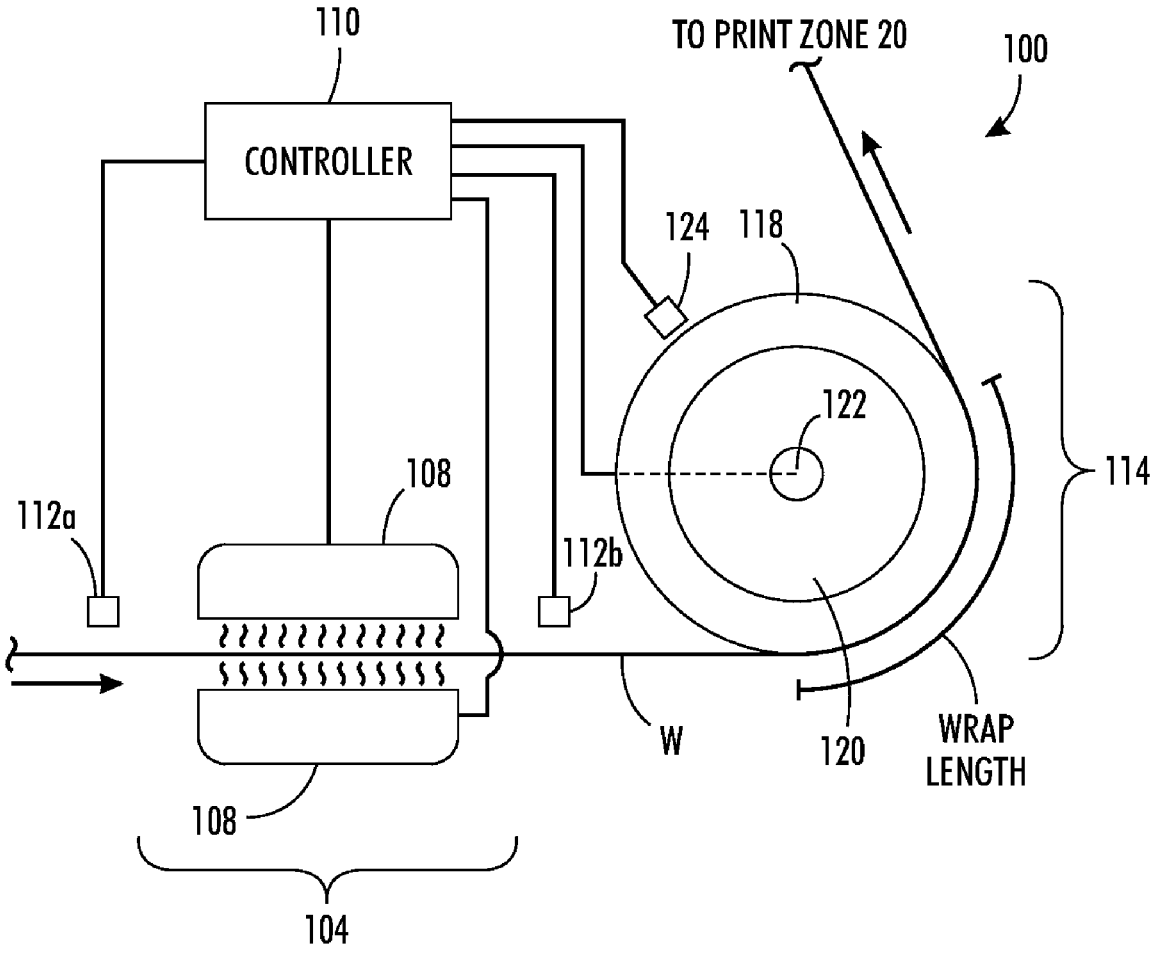
FIG. 2 is a schematic view of an embodiment of two stage preheating system for use with the imaging device of FIG. 1.

As an alternative to such previously known systems, the present disclosure proposes a two stage preheating system in which the first stage includes a non-contact radiant heater configured to heat the incoming web to an initial preheat temperature that is higher than the target temperature for the preheat system and the second stage includes a preheat roller configured to bring the temperature down, or cool, the web to the target temperature. One object of heating the web to an initial preheat temperature higher than the target temperature is to drive moisture out of the paper to, in effect, preshrink the web prior to entering the print zone. The initial preheat temperature may be any suitable temperature that is capable of preventing or minimizing media shrinkage in the print zone. In one embodiment, the initial preheat temperature is selected to be about 20° C. greater than the target temperature. As mentioned above, a temperature gradient of 20° C. between the web and the preheat roller surface results in only about a 1° C. temperature change at the roller surface when contacted by a web at ambient temperature. Thus, by having an initial preheat temperature that is around 20° C. above the preheat roller surface, contact between the preheat roller surface and the web results in minimal temperature fluctuations at the roller surface. In addition, the temperature change at the roller surface due to the contact is a spike, or increase, rather than a drop, or decrease, which has the benefit of decreasing power consumption Referring now to FIG. 2, an embodiment of two stage preheating system 100 is shown. The preheating system 100 is configured to provide the web W to the print zone 20 at a predetermined target temperature selected to provide a desired image quality. In one embodiment, the target temperature for the preheating system corresponds to the temperature at which the web is kept as it is moved through the print zone although not necessarily. The target temperature for the preheating system may be any suitable temperature. In one embodiment, the target temperature for the preheating system may be any temperature in a range from about 30° C. to about 70° C., and in one particular embodiment, is approximately 55° C. As depicted, the preheating system 100 includes a first stage 104 comprised of at least one radiant heating unit 108 positioned to emit thermal radiation onto the web W. In the embodiment of FIG. 2, two radiant heating units 108 are shown with one unit positioned to emit thermal radiation onto each side of the web. Any suitable number of heating units, of course, may be utilized. The web is heated by absorbing the thermal radiation from the units 104 emitted at a predetermined temperature that is configured to heat the web to an initial preheat temperature that is greater than the target temperature for the preheating system. In one embodiment, the initial preheat temperature is selected to be 20° C. greater than the target temperature for the preheating system. Thus, for a target temperature of about 55° C., an initial preheat temperature may be approximately 75° C. The initial preheat temperature, however, may be any suitable temperature that is greater than the target temperature.

The development of thermal energy in the heating units 108 may be accomplished in any suitable manner. For example, heat may be generated in a heating unit by a resistance heating element. Alternatively, a heating unit 108 may include one or more heating lamps such as quartz, carbon filament or halogen lamps mounted between a ceramic backing and a protective quartz plate (front side). In any case, the heating unit is configured to emit thermal radiation in accordance with an electrical current provided by one or more heater power supplies (not shown). A web heating controller 110 is operable to control the amount of electrical current supplied to the heating unit via the power supply. The radiant heating units 108 may be provided with retraction mechanisms (not shown) as are known in the art to remove the heating units from proximity to the web and/or web path in the event of web breakage and/or stoppage.

The web heating controller 110 may be implemented as hardware, software, firmware or any combination thereof. In addition, the web heating controller may be a standalone controller or may be incorporated into the system controller. The web heating controller 110 is operable to control the thermal radiation emitted by the radiant heating unit(s) 108 based, at least in part, on the measured temperature of the media web. To that end, the web heating system may include one or more temperature sensors 112 as are known in the art for measuring the temperature of the moving web W at one or more locations prior to, during, and after heating by the radiant heaters. Temperature sensors 112 may comprise non-contact type sensors such as thermopile or similar IR sensor. In one embodiment, a temperature sensor 112*a* is provided along the media pathway just upstream from the radiant heating units 108 of the web heating system to detect the temperature of the web upstream from the radiant heating units. Another temperature sensor 112*b* may also be provided along the media pathway downstream from the radiant heating units 108 prior to the web contacting the preheat roller to detect the temperature of the web after being heated by the heating units. In any case, the temperature sensors 112*a* and 112*b* are operable to relay signals indicative of the one or more measured temperatures to the heating controller 110. The controller 110 is operable to control power to the heating units 108 based on the signals received from the temperature sensors 112 in order to heat the web to the desired initial preheat temperature. The controller 110 may be implemented as hardware, software, firmware or any combination thereof, and may be a standalone controller or be incorporated into the system controller.

In the embodiment of FIG. 2, the second stage 114 of the preheating system 100 includes a preheat roller 118. The preheat roller 118 is a temperature controlled, thermally conductive roller configured to be heated to a temperature that enables the roller surface to bring the temperature of the web to the target temperature. As shown in FIG. 1, the preheat roller 118 is placed along the web path downstream from the radiant heating units 108 in the process direction just prior to the print zone 20. In one embodiment, the preheat roller 118 is configured as an idler roller that derives its rotational motion from frictional engagement of the roller surface with the moving web. However, the preheat roller 118 may be a driven in accordance with the web speed by a drive mechanism (not shown). Tension rollers (not shown) may also be provided to control the carrying in angle and/or carrying out angle of the web relative to the preheat roller 118.

The development of thermal energy in the preheat roller 118 may be accomplished in any suitable manner. For example, the core 120 may be hollow and include one or more heating elements 122 disposed therein for generating the required thermal energy in the roller. The heater 122 in the core may comprise a heating lamp such as quartz, carbon filament or halogen lamps. The roll temperature can also be heated or cooled with a fluid flowing through the roller and temperature controlled by an external device (current practice on our fixture). The heater 122 of the preheat roller 118 is configured to emit thermal energy to heat the roller in accordance with an electrical current provided by one or more heater power supplies (not shown). Although internal heating means have been described for heating the preheat roller 118, the preheat roller may be heated by external heaters or a combination of internal and external heaters.

One or more temperature sensors 124 may be provided for sensing the temperature of the preheat roller 118 and providing appropriate input to the controller 110. Temperature sensors 124 may be any type of temperature sensing device that generates an analog or digital signal indicative of a temperature in the vicinity of the sensor. Such sensors include, for example, thermistors that predictably change in some electrical property, such as resistance, in response to the absorption of heat. The controller 110 is connected to the temperature sensor 124 and to the power sources (not shown) of the heater 122 of the preheat roller. The controller 110 receives signals from the temperature sensor 124 indicative of the temperature of the preheat roller 118 and compares the sensed temperature of the roller to predetermined threshold values. Based on the comparison, the controller 110 may adjust the power to the preheat roller heater 122 to maintain the preheat roller 118 at a temperature that enables the web to be brought to the target temperature for the preheating system 100.

During operation, as the web W is moved along the web path, the web W is wrapped partially around the preheat roller 118. The length of the web that contacts the preheat roller is referred to herein as the wrap length, or contact length. Contact between the web heated to the initial preheat temperature by the first stage of the preheating system and the lower temperature of the preheat roller 118 (e.g., heated to the target temperature) causes conductive heat transference to occur between the web W and the preheat roller 118 thereby lowering the temperature of the web toward the target temperature of the preheat roller 118. The extent to which the web temperature may be changed by contact with the preheat roller is generally a function of the temperature of the preheat roller 118, and the length of time, or dwell time, that the web W remains in contact with the preheat roller 118. As used herein, dwell time refers to the maximum amount of time that any given point on the web remains in contact with the preheat roller. Dwell time between the web W and the preheat roller 118 is dependent upon the speed that the web is moving and the wrap length, or contact length, between the web and the preheat roller. The wrap length at which the web is in contact with the web may be any suitable wrap length that is capable of creating adequate dwell time to bring the temperature of the web to the target temperature for the preheating system 100.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device comprising:

a source of a substantially continuous web of media;

a web transport system configured to transport the continuous web from the source along a web path, the web path including a print zone;

at least one printhead positioned in the print zone adjacent the web and configured to deposit ink onto the web to form images thereon; and a preheating system positioned along the web path between the source and the print zone, the preheating system including a first heating stage and a second heating stage, the first heating stage having at least one non-contact radiant heating unit positioned to emit thermal radiation onto the web at a level that enables the web to be heated to an initial preheat temperature prior to reaching the second stage, the second stage including a preheat roller having a heater configured to generate thermal energy to heat the preheat roller to a target temperature, the preheat roller being positioned to be partially wrapped by the continuous web after passing the first heating stage to generate a predetermined dwell time between the continuous web and the preheat roller as the continuous web is being transported, the predetermined dwell time being configured to enable conductive heat transfer to occur between the continuous web and the preheat roller to bring the temperature of the continuous web to the target temperature.

2. The imaging device of claim 1, the ink comprising melted phase change ink.

3. The imaging device of claim 1, the initial preheat temperature being 20° C. greater than the target temperature.

4. The imaging device of claim 1, the target temperature being between approximately 30° C. and approximately 70° C.

5. The imaging device of claim 4, the target temperature being 55° C.

6. The imaging device of claim 1, further comprising:

a spreader positioned downstream from the print zone and configured to apply pressure to the web and the ink deposited thereon in the print zone.

7. The imaging device of claim 1, further comprising:

a temperature sensor configured to detect a temperature of the web prior to reaching the print zone and to generate a temperature signal indicative of the detected temperature; and a controller configured to receive the temperature signal and to control power to at least one of the heater of the preheat roller of the second heating stage and the at least one radiant heating unit of the first heating stage.

8. A method of operating a continuous feed, direct marking imaging device, the method comprising:

transporting a substantially continuous web along a web path having a preheating system arranged adjacent thereto and a print zone arranged downstream from the preheating system;

emitting thermal radiation onto the web at a level that enables the web to be heated to an initial preheat temperature using at least one non-contact radiant heating;

reducing a temperature of the web from the initial preheat temperature to a target temperature for the web at a second heating stage of the preheating system by wrapping the continuous web partially around a preheat roller to generate a predetermined dwell time between the continuous web and the preheat roller after the continuous web has been heated to the initial preheat temperature at the first heating stage, the preheat roller including a heater configured to generate thermal energy to heat the preheat roller to the target temperature, the predetermined dwell time being configured to enable conductive heat transfer to occur between the continuous web and the preheat roller to bring the temperature of the continuous web to the target temperature; and after reducing the temperature of the web to the target temperature, depositing ink onto the web in the print zone to form images thereon.

9. The method of claim 8, the ink comprising melted phase change ink.

10. The method of claim 8, the initial preheat temperature being 20° C. greater than the target temperature.

11. The method of claim 8, the target temperature being between approximately 30° C. and approximately 70° C.

12. The method of claim 11, the target temperature being 55° C.

13. The method of claim 8 further comprising:

applying pressure to the web and the ink deposited thereon downstream from the print zone.

14. An imaging device comprising:

a source of a substantially continuous web of media;

a web transport system configured to transport the continuous web from the source along a web path, the web path including a print zone;

at least one printhead positioned in the print zone adjacent the web and configured to deposit melted phase change ink onto the web to form images thereon; and a preheating system positioned along the web path between the source and the print zone, the preheating system including a first heating stage and a second heating stage, the first heating stage having at least one non-contact radiant heating unit positioned to emit thermal radiation onto the web at a level that enables the web to be heated to an initial preheat temperature prior to reaching the second stage, the second stage including a preheat roller having a heater configured to generate thermal energy to heat the preheat roller to a target temperature, the preheat roller being positioned to be partially wrapped by the continuous web after passing the first heating stage to generate a predetermined dwell time between the continuous web and the preheat roller as the continuous web is being transported, the predetermined dwell time being configured to enable conductive heat transfer to occur between the continuous web and the preheat roller to bring the temperature of the continuous web to the target temperature; and a spreader positioned along the web path downstream from the print zone and configured to apply pressure to the web and the ink deposited thereon in the print zone.

15. The imaging device of claim 14, the initial preheat temperature being 20° C. greater than the target temperature.

* * * * *